US010223941B2

(12) United States Patent
Anzalone

(10) Patent No.: US 10,223,941 B2
(45) Date of Patent: Mar. 5, 2019

(54) NAMEPLATES AND LOCKING ASSEMBLIES THEREOF

(71) Applicant: Michael Joseph Anzalone, Centereach, NY (US)

(72) Inventor: Michael Joseph Anzalone, Centereach, NY (US)

( * ) Notice: Subject to any disclaimer, the term of this patent is extended or adjusted under 35 U.S.C. 154(b) by 225 days.

(21) Appl. No.: 14/863,758

(22) Filed: Sep. 24, 2015

(65) Prior Publication Data

US 2017/0092161 A1 Mar. 30, 2017

(51) Int. Cl.
*G09F 7/10* (2006.01)
*G09F 7/18* (2006.01)

(52) U.S. Cl.
CPC ..... *G09F 7/18* (2013.01); *G09F 7/10* (2013.01); *G09F 2007/1843* (2013.01); *G09F 2007/1856* (2013.01)

(58) Field of Classification Search
CPC ..... G09F 2007/1843; G09F 2007/1856; G09F 7/08; G09F 7/10
USPC ..... 40/611.07, 611.11, 661.01, 711, 712
See application file for complete search history.

(56) References Cited

U.S. PATENT DOCUMENTS 511,167 A * 12/1893 Shaffer ..... E05B 47/0044 292/150
1,894,803 A 1/1933 Wahlstrom
2,124,025 A 7/1938 Braun
2,176,535 A 10/1939 Markoff
2,309,407 A 1/1943 McBeath
3,142,920 A 8/1964 Nelson et al.
3,741,548 A 6/1973 Kaupp
3,744,833 A * 7/1973 Berducone ..... E05L 347/0038 292/251.5
3,838,529 A 10/1974 Aybar
3,981,092 A 9/1976 Ramsdale
4,184,277 A * 1/1980 Larin ..... G09F 7/10 40/490
4,187,630 A 2/1980 Giulie et al.
4,357,767 A * 11/1982 Ross ..... G09F 7/10 40/1.5
4,583,309 A * 4/1986 Kane ..... A47G 1/0655 40/711
4,602,447 A 7/1986 Feingold
4,643,452 A 2/1987 Chang
4,672,758 A 6/1987 Le-Carpentier et al.
(Continued)

OTHER PUBLICATIONS

Swiss Re design drawings dated Nov. 16, 1996 (1 page).
Mancini-Duffy Architectural Design (1 page).

*Primary Examiner* — Kristina N Junge
(74) *Attorney, Agent, or Firm* — Carter, DeLuca, Farrell & Schmidt, LLP

(57) ABSTRACT

A nameplate includes a nameplate holder, a nameplate insert, and a locking member. The nameplate holder defines a longitudinal channel. The nameplate insert defines a notch and is configured for movable receipt within the longitudinal channel of the nameplate holder. The locking member is movable within the nameplate holder between a first condition and a second condition. In the first condition, a portion of the locking member extends within the notch of the nameplate insert to resist longitudinal movement of the nameplate insert relative to the nameplate holder. In the second condition, the portion of the locking member is disposed outside of the notch of the nameplate insert.

16 Claims, 8 Drawing Sheets

(56) References Cited

U.S. PATENT DOCUMENTS 4,679,341 A 7/1987 Goldman
4,790,093 A 12/1988 Ernest et al.
5,189,822 A 3/1993 Schmanski et al.
5,335,434 A 8/1994 Shultz et al.
5,369,900 A * 12/1994 Garrison ..... G09F 7/00 40/590
5,526,597 A 6/1996 Plotkin et al.
5,555,977 A 9/1996 Oshry et al.
5,586,401 A 12/1996 Sheehan et al.
5,911,525 A 6/1999 Jepsen et al.
6,006,459 A 12/1999 Kosmach
6,119,381 A 9/2000 Grocholski
6,316,073 B1 11/2001 Hiscock et al.
D451,555 S 12/2001 Smith
6,374,523 B1 4/2002 Smith
6,553,704 B1 4/2003 Pigg
6,675,514 B1 1/2004 Salimes et al.
6,745,509 B1 6/2004 Lapp
6,792,710 B2 9/2004 Whitlow et al.
6,986,422 B2 1/2006 Boatwright
7,055,275 B1 6/2006 Teza et al.
7,143,535 B1 12/2006 Cobb et al.
7,266,920 B2 9/2007 Kao
7,422,348 B1 9/2008 Yates, II
7,954,267 B2 6/2011 Anzalone
8,046,945 B2 11/2011 Radcliffe
8,695,255 B2 4/2014 Anzalone
8,769,850 B1 * 7/2014 Mottola ..... B62J 99/00 40/590
2007/0180747 A1 8/2007 Anzalone
2012/0023797 A1 * 2/2012 Rosander ..... G09F 3/204 40/655
2013/0074389 A1 * 3/2013 Anzalone ..... G09F 7/10 40/700
2015/0302781 A1 * 10/2015 Jacobson ..... G09F 7/18 40/491

* cited by examiner

NAMEPLATES AND LOCKING ASSEMBLIES THEREOF

BACKGROUND

Nameplates are generally used to display information, such as, for example, a name of a person, organization, a product, or a service. Nameplates may be mounted to a variety of surfaces to display said information. For example, nameplates may be mounted to a wall outside of an office to identify the name of the occupant of the office, to a billboard, to a vertically extending stand, or between two parallel, vertically extending stands.

Typically, nameplates include nameplate inserts that contain the information to be displayed. It is desirable for nameplate inserts to be removably attached to or inserted within a nameplate holder. By being removable, the nameplate inserts can be changed or replaced, for example, when advertising material needs to be updated or when an occupant of an office changes.

In addition to nameplate inserts being interchangeable, they should also be able to be firmly secured with the nameplate holder such that the selected nameplate insert isn't unintentionally removed or placed out of position by a variety of factors, for example, a casual touching, wind, or vibrations.

Accordingly, a need exists for a nameplate that exhibits at least the desired qualities noted above.

SUMMARY

In one aspect of the present disclosure, a nameplate is provided. The nameplate includes a nameplate holder, a nameplate insert, and a locking member. The nameplate holder defines a longitudinal channel. The nameplate insert defines a notch and is configured for movable receipt within the longitudinal channel of the nameplate holder. The locking member is movable within the nameplate holder between a first condition and a second condition. In the first condition, a portion of the locking member extends within the notch of the nameplate insert to resist longitudinal movement of the nameplate insert relative to the nameplate holder. In the second condition, the portion of the locking member is disposed outside of the notch of the nameplate insert such that longitudinal movement of the nameplate insert within the longitudinal channel is permitted.

In some embodiments, at least a region of the locking member may be metallic. It is contemplated that the metallic region may be a metal ball.

In some aspects of the present disclosure, the nameplate may further include a capture member having a metallic region. The capture member may be configured for removable receipt in the nameplate holder, adjacent the locking member to maintain the locking member within the nameplate holder. The nameplate may further include a magnetic member configured to move the locking member between the first and second conditions via the metallic region of the locking member. The magnetic member may also be configured to remove the locking member and the capture member from the nameplate holder.

It is envisioned that the nameplate holder may further define a cavity in communication with the longitudinal channel. The cavity may be configured for movable receipt of the locking member. The cavity may be in the form of a counterbore.

It is contemplated that the locking member may include a body. The portion of the locking member may project from the body such that in the first condition, the body of the locking member is disposed within the cavity of the nameplate holder and the portion of the locking member protrudes into the longitudinal channel of the nameplate holder.

In some embodiments, the nameplate may further include a resilient member configured for receipt in the cavity of the nameplate holder. The resilient member may be supported on the locking member. In the first condition, the resilient member may be in a non-compressed condition in which the portion of the locking member protrudes into the longitudinal channel of the nameplate holder. In the second condition, the resilient member may be in a compressed condition in which the portion of the locking member is disposed within the cavity of the nameplate holder. It is envisioned that the locking member may have an annular shape.

In some aspects of the present disclosure, the portion of the locking member may move from the second condition to the first condition upon engagement of the nameplate insert with the locking member. The portion of the locking member may be fabricated from a resilient material such that the portion of the locking member flexes from the second condition to the first condition upon engagement of the nameplate insert with the locking member.

It is contemplated that the nameplate insert may include a first longitudinal side and a second longitudinal side. The longitudinal channel of the nameplate holder may include a first longitudinal groove for receiving the first longitudinal side of the nameplate insert, and a second longitudinal groove for receiving the second longitudinal side of the nameplate insert.

In some embodiments, the notch of the nameplate insert may be defined in a first longitudinal side of the nameplate insert. The nameplate insert may define another notch in a second longitudinal side of the nameplate insert. The notch defined in the first longitudinal side of the nameplate insert may have a first dimension and the other notch defined in the second longitudinal side of the nameplate insert may have a second dimension, different than the first dimension.

In another aspect of the present disclosure, a nameplate is provided that includes a nameplate holder defining a longitudinal channel and a counterbore. The longitudinal channel is configured for removable receipt of a nameplate insert. The counterbore is in communication with the longitudinal channel and is configured for movable receipt of a locking member.

In some embodiments, the locking member may include a body and a projection stemming from the body such that in a first condition of the locking member, the body of the locking member is disposed within the counterbore of the nameplate holder and the projection of the locking member protrudes into the longitudinal channel of the nameplate holder.

It is contemplated that at least a region of the locking member may be metallic.

It is envisioned that at least a portion of the locking member may be fabricated from a resilient material such that the portion of the locking member flexes from a non-compressed condition to a compressed condition. In the non-compressed condition, the portion of the locking member may protrude into the longitudinal channel of the nameplate holder. In the compressed condition, the portion of the locking member may be disposed within the counterbore of the nameplate holder.

In some embodiments, the nameplate may further include a resilient member configured for receipt in the counterbore of the nameplate holder and supported on the locking member. In a compressed condition of the resilient member, at least a portion of the locking member may be disposed within the counterbore of the nameplate holder. In a non-compressed condition of the resilient member, the portion of the locking member may protrude into the longitudinal channel of the nameplate holder.

Further details, advantages, and aspects of exemplary embodiments of the present disclosure are described in more detail below with reference to the appended figures.

As used herein, the terms parallel and perpendicular are understood to include relative configurations that are substantially parallel and substantially perpendicular up to about + or −10 degrees from true parallel and true perpendicular.

BRIEF DESCRIPTION OF THE DRAWINGS

Embodiments of the present disclosure are described herein with reference to the accompanying drawings, wherein.

DETAILED DESCRIPTION

Figure 1:
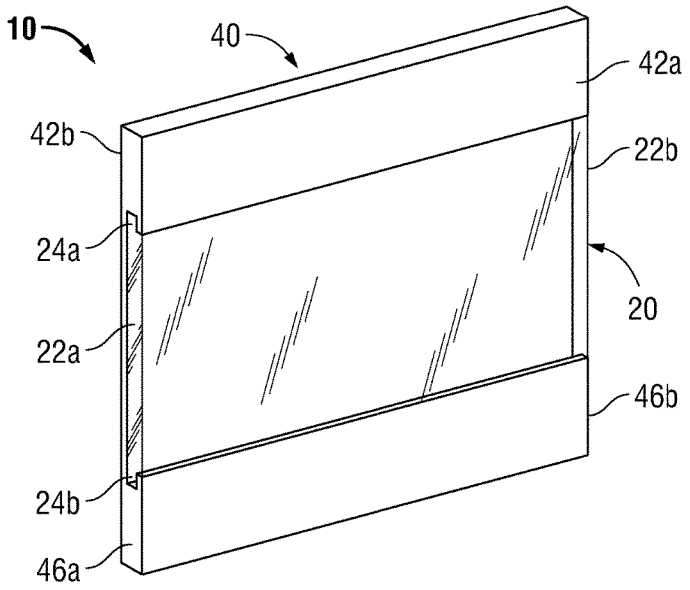
FIG. 1 is a perspective view of one embodiment of a nameplate including a nameplate insert received within a nameplate holder.

Embodiments of the presently disclosed nameplates and locking assemblies thereof are described in detail with reference to the drawings, in which like reference numerals designate identical or corresponding elements in each of the several views.

Figure 2:
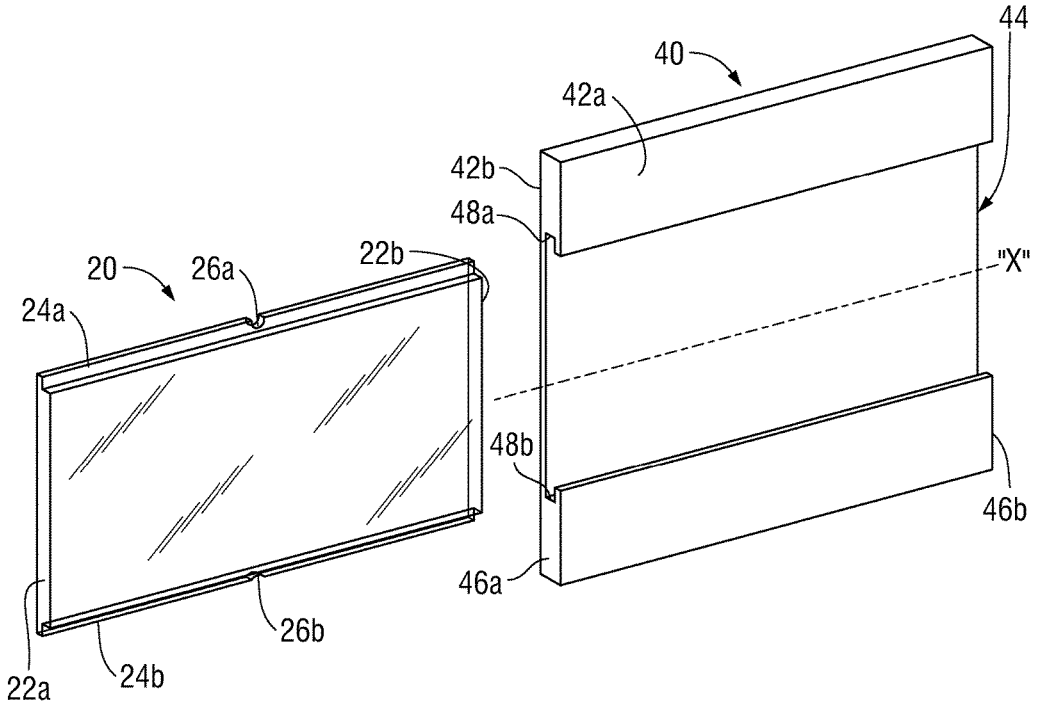
FIG. 2 is a perspective view of the nameplate of FIG. 1 illustrating the nameplate insert separated from the nameplate holder.

Referring initially to FIGS. 1 and 2, illustrated is a nameplate for displaying information and is generally designated by reference numeral 10. Nameplate 10 generally includes a nameplate insert 20 and a nameplate holder 40 configured to releasably receive or retain nameplate insert 20. Nameplate 10 further includes a locking assembly 70 (FIG. 3) that effectively retains nameplate insert 20 with nameplate holder 40 while also allowing for nameplate insert 20 to be selectively disengaged from nameplate holder 40.

Figure 3:
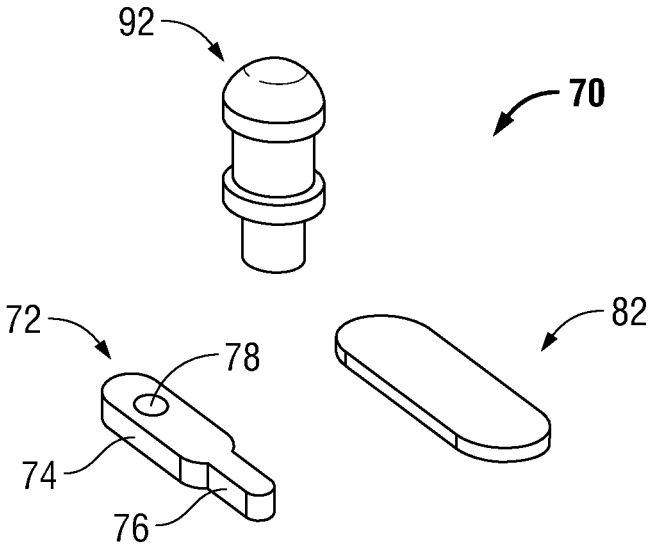
FIG. 3 is a perspective view of a locking assembly of the nameplate of FIG. 1.

Nameplate insert 20 is configured to include indicia (not shown), such as, for example, a name of a person, organization, product, service, or the like, for easy visual identification. The indicia may be engraved into nameplate insert 20, adhered to nameplate insert 20, or written onto an outer surface of nameplate insert 20. Nameplate insert 20 has a generally rectangular shape and has a first lateral side 22*a*, a second lateral side 22*b*, an upper longitudinal side 24*a*, and a lower longitudinal side 24*b*. Longitudinal sides 24*a*, 24*b* each have a stepped configuration for receipt in correspondingly shaped grooves of nameplate holder 40. Upper longitudinal side 24*a* defines a notch therein configured to capture a portion 176 of a locking member 172 (FIG. 3), as will be described in greater detail below. Notch 26*a* is disposed intermediary of first and second lateral sides 22*a*, 22*b*. Lower longitudinal side 24*b* may also define a notch 26*b* therein that is also configured to capture the portion 176 of the locking member 172 (FIG. 3).

With continued reference to FIGS. 1 and 2, nameplate includes a nameplate holder 40. Nameplate holder 40 has a rectangular shape. In some embodiments, nameplate holder 40 may be variously shaped, such as, for example, triangular, circular, oblong, polygonal, or the like. Nameplate holder 40 may be made from various materials, for example, metals, plastics, or glass. Nameplate holder 40 may have various attachment mechanisms for mounting to a fixed surface, such as, for example, a wall. Nameplate holder 40 may also be configured to be supported on a surface or hung from a surface.

Nameplate holder 40 includes a front surface 42*a* and a rear surface 42*b*. Front surface 42*a* defines a longitudinal channel 44 that extends from a first lateral side 46*a* of nameplate holder 40 to a second lateral side 46*b* of nameplate holder 40. Longitudinal channel 44 is configured to slidably receive a nameplate insert, such as, for example, nameplate insert 20 described above. Longitudinal channel 44 has first and second longitudinal grooves 48*a*, 48*b* that capture upper and lower longitudinal sides 24*a*, 24*b* of nameplate insert 20, respectively.

Figure 4A:
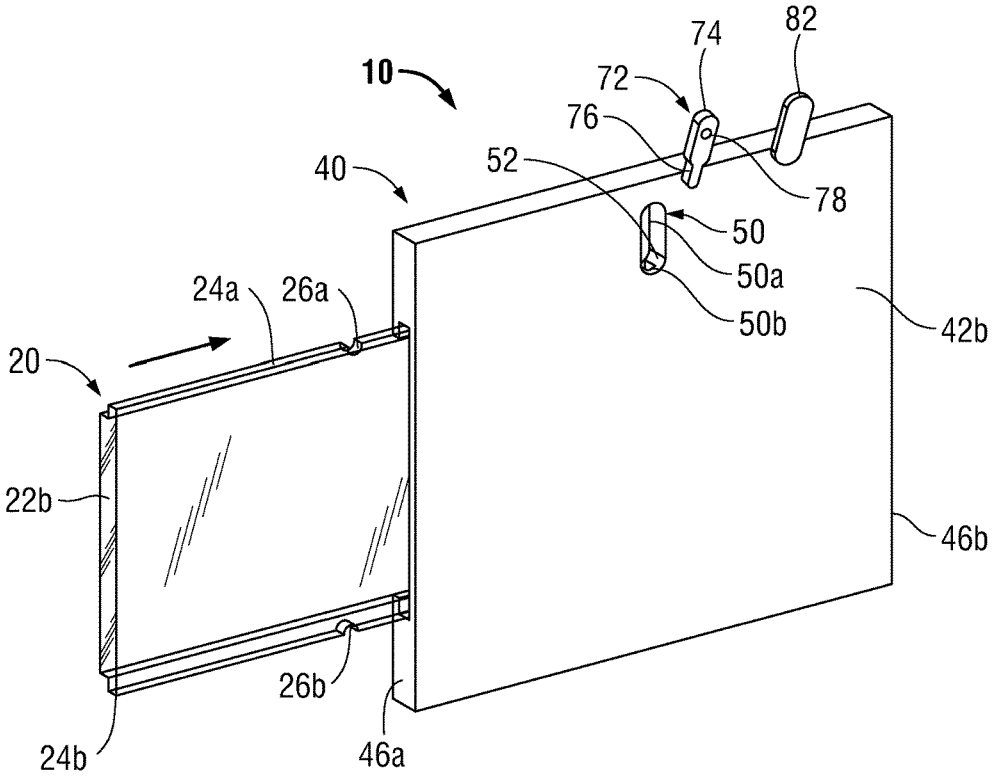
FIG. 4A is a rear, perspective view of the nameplate of FIG. 1 including the locking assembly, with parts separated.
Figure 4B:
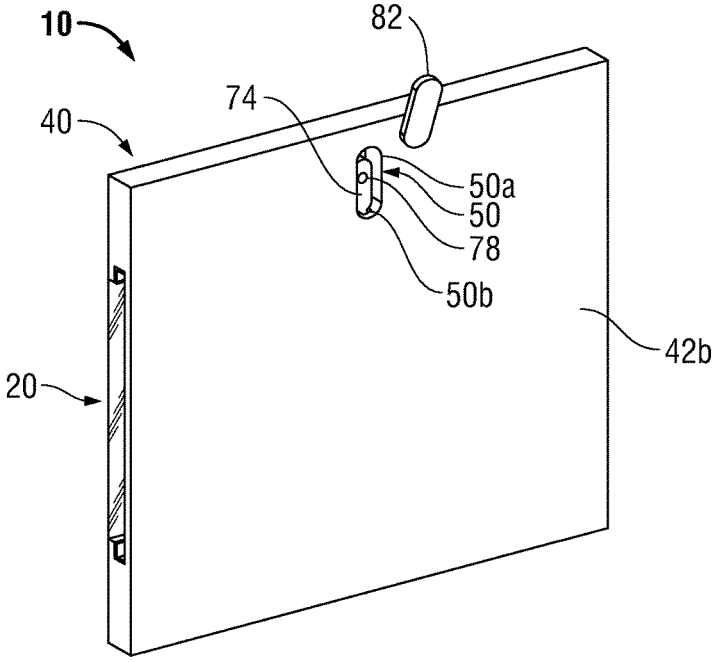
FIG. 4B is a rear, perspective view of the nameplate of FIG. 4A with a locking member of the locking assembly in a locking condition.
Figure 5:
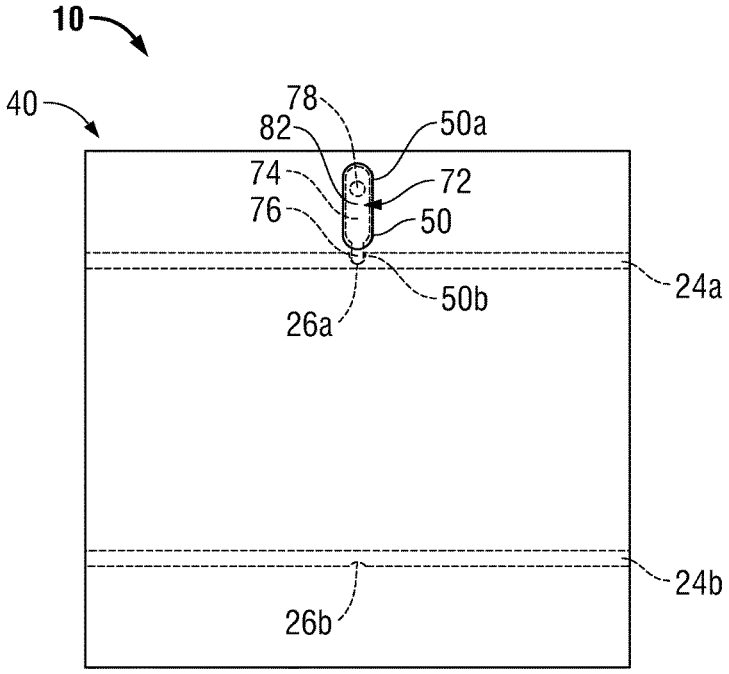
FIG. 5 is a rear, plan view, in part phantom, of the nameplate of FIG. 4C.

With reference to FIG. 4A, rear surface 42*b* of nameplate holder 40 defines a cavity, such as, for example, a counterbore 50 for removable receipt of the locking assembly 70 (FIG. 3), as will be described in greater detail below. Counterbore 50 includes a first hole 50*a* and a second hole 50*b*, smaller than first hole 50*a*, and contiguous with first hole 50*a*. First hole 50*a* has a generally oblong shape and is disposed above and in the same plane as longitudinal channel 44 of nameplate holder 40 and intermediate of first and second lateral sides 46*a*, 46*b* of nameplate holder 40. A bottom 52 of first hole 50*a* surrounds second hole 50*b* to provide a surface on which to support components of locking assembly 70 (FIG. 3), as will be described in greater detail below. Second hole 50*b* is contiguous with longitudinal channel 44 (See FIG. 5) such that longitudinal channel 44 can be accessed through counterbore 50.

With reference to FIGS. 3, 4A-4C, and 5, nameplate 10 includes a locking assembly 70 for releasably locking nameplate insert 20 within longitudinal channel 44 of nameplate holder 40. Locking assembly 70 generally includes a locking member 72, a capture member 82, and a magnetic member 92. Locking member 72 is movable within counterbore 50 of nameplate holder 40 between a first or locking condition in which nameplate insert 20 is locked with nameplate holder 40, and a second or non-locking condition in which nameplate insert 20 is unlocked from nameplate holder 40.

Locking member 72 has a body 74 and a portion, such as, for example, a projection 76 stemming from body 74. Body 74 of locking member 72 is configured for disposal within first hole 50*a* of counterbore 50 and projection 74 of locking member 72 is configured for disposal in second opening 50*b* of counterbore 50. Body 74 of locking member 72 has a length that is less than a length of first hole 50*a* of counterbore 50 such that locking member 72 is movable within counterbore 50 in a direction perpendicular to a longitudinal axis "X" (FIG. 2) of nameplate holder 40. Upon disposing locking member 72 in counterbore 50, body 74 of locking member 72 is supported on bottom 52 of first hole 50*a* and projection 76 of locking member 72 extends through second opening 50*b* of counterbore 50 and protrudes into longitudinal channel 44 of nameplate holder 40. Projection 76 of locking member 72 protrudes into longitudinal channel 44 of nameplate holder 40 a distance equal to a depth of notch 26*a* defined in nameplate insert 20.

Locking member 72 further includes a metallic region, such as, for example, a metallic ball 78. Metallic ball 78 is disposed within body 74 of locking member 72. In some embodiments, metallic ball 78 may be attached to or disposed within any region of locking member 72. It is contemplated that a portion or an entirety of locking member 72 may be metallic.

Figure 4C:
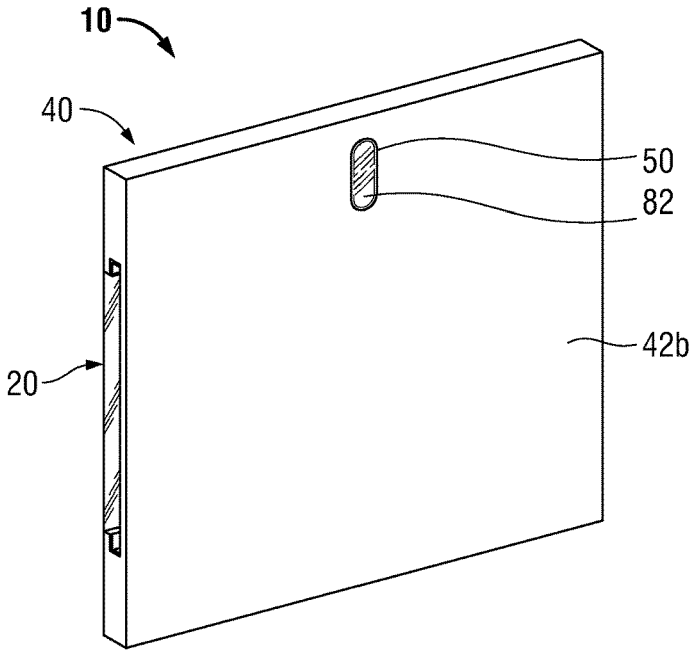
FIG. 4C is a rear, perspective view of the nameplate of FIG. 1 illustrating the nameplate in the locking condition.

Locking assembly 70 further includes a metal-containing capture member 82. Capture member 82 is dimensioned and shaped to correspond to the dimension and shape of first hole 50*a* of counterbore 50. As such, as shown in FIG. 4C, upon positioning locking member 72 and capture member 82 within counterbore 50, capture member 82 is disposed flush with rear surface 42*b* of nameplate holder 40, adjacent locking member 72, to resist lateral movement of locking member 72 within counterbore 50. In some embodiments, capture member 82 may be non-metallic. In further embodiments, capture member 82 may be friction fitted within first hole 50*a* of counterbore 50. It is also envisioned that a backing, such as, for example, a sticker (not shown) may be positioned over capture member 82 to retain capture member 82 within hole 50*a*.

With reference to FIGS. 4A-4C and 5, in assembly, operation, and use, nameplate holder 40 is mounted to or hung from a surface (not shown). Nameplate insert 20 is slid into longitudinal channel 44 of nameplate holder 40 to align notch 26*a* of nameplate insert 20 with counterbore 50 of nameplate holder 40 (See FIG. 5). To selectively lock nameplate insert 20 within longitudinal channel 44 of nameplate holder 40, locking member 72 is positioned within counterbore 50. Upon positioning locking member 72 within counterbore 50, gravity causes projection 76 of locking member 72 to extend through second opening 50*b* of counterbore 50 and into notch 26*a* of nameplate insert 20 such that movement of nameplate insert 20 along longitudinal axis "X" relative to nameplate holder 40 is resisted by locking member 72.

Figure 6A:
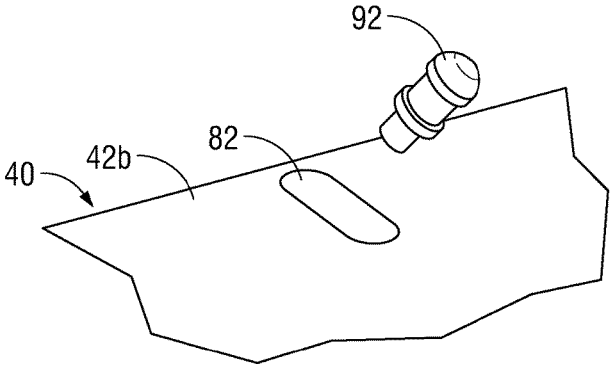
FIGS. 6A-6C are a series of perspective, cutaway views of the nameplate of FIG. 1 illustrating a removal of the locking member from the nameplate holder using a magnetic member.
Figure 6B:
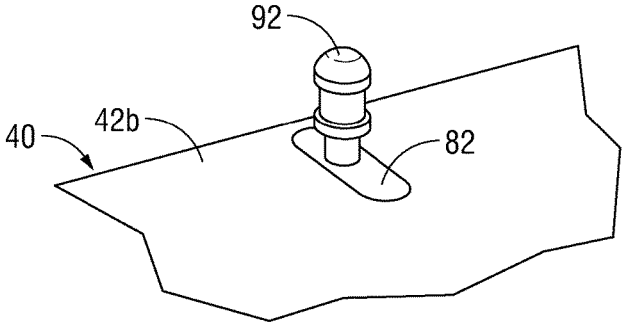

With reference to FIGS. 6A and 6B, magnetic member 92 may also be used to facilitate moving locking member 72 to the first or locking condition. In particular, magnetic member 92 may be placed adjacent metallic ball 76 of locking member 72 to create a magnetic attraction between magnetic member 92 and locking member 72. As such, downward movement of magnetic member 92, towards longitudinal channel 44, effects downward movement of locking member 72 to dispose projection 76 within notch 26*a* of nameplate insert 20.

Figure 6C:
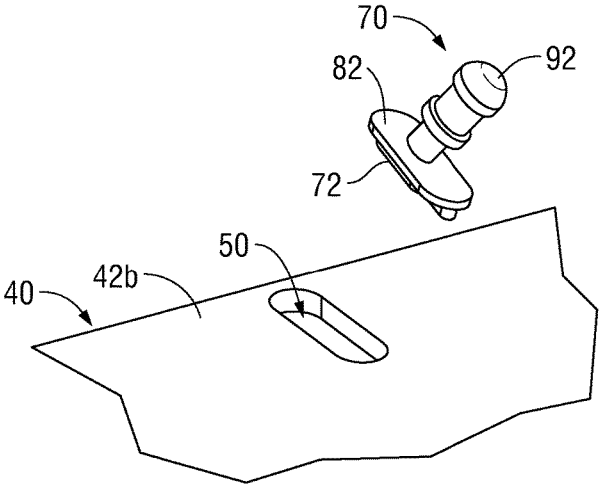

With reference to FIGS. 6A-6C, nameplate insert may be selectively removed from longitudinal channel 44 of nameplate holder 40 to replace nameplate insert 20. To remove nameplate insert 20, locking member 72 is first disengaged from notch 26*a* of nameplate insert 20. Specifically, magnetic member 92 is positioned in abutment with metal-containing capture member 82 creating a magnetic attraction between magnetic member 92, locking member 72, and capture member 82. Magnetic member 92 is moved up away from longitudinal channel 44, which, in turn, moves locking member 72 within counterbore 50, in a direction away from longitudinal channel 44, via the magnetic attraction between magnetic member 92 and metallic ball 78 of locking member 72. As locking member 72 moves up, projection 76 of locking member 72 exits notch 26*a* of nameplate insert 20 to unlock nameplate insert 20 from nameplate holder 40. In some embodiments, to move locking member 72 out of notch 26*a*, magnetic member 92 may be placed on a top edge of nameplate holder 40, which will lift locking member 72 up and out of notch 26*a*.

With locking member 72 in the second or non-locking condition, nameplate insert 20 may be slid along longitudinal channel 44 of nameplate holder 40 to disengage nameplate insert 20 from nameplate holder 40. Magnetic member 92 may also be pulled away from rear surface 42*b* of nameplate holder 40 to remove both capture member 82 and locking member 72 from counterbore 50. Locking member 72 may re-engage notch 26*a* of nameplate insert 20 by moving magnetic member 92 down, towards longitudinal channel 44, to re-lock nameplate insert 20 to nameplate holder 40.

In one embodiment, as shown in FIGS. 7, 8A, 8B, and 9, a nameplate 100, similar to nameplate 10 described above, is provided. Nameplate 100 generally includes a nameplate insert 120, similar to nameplate insert 20, and a nameplate holder 140, similar to nameplate holder 40. Nameplate 100 further includes a locking assembly 170 that effectively retains nameplate insert 120 with nameplate holder 140 while also allowing for nameplate insert 120 to be selectively disengaged from nameplate holder 140.

Figure 7:
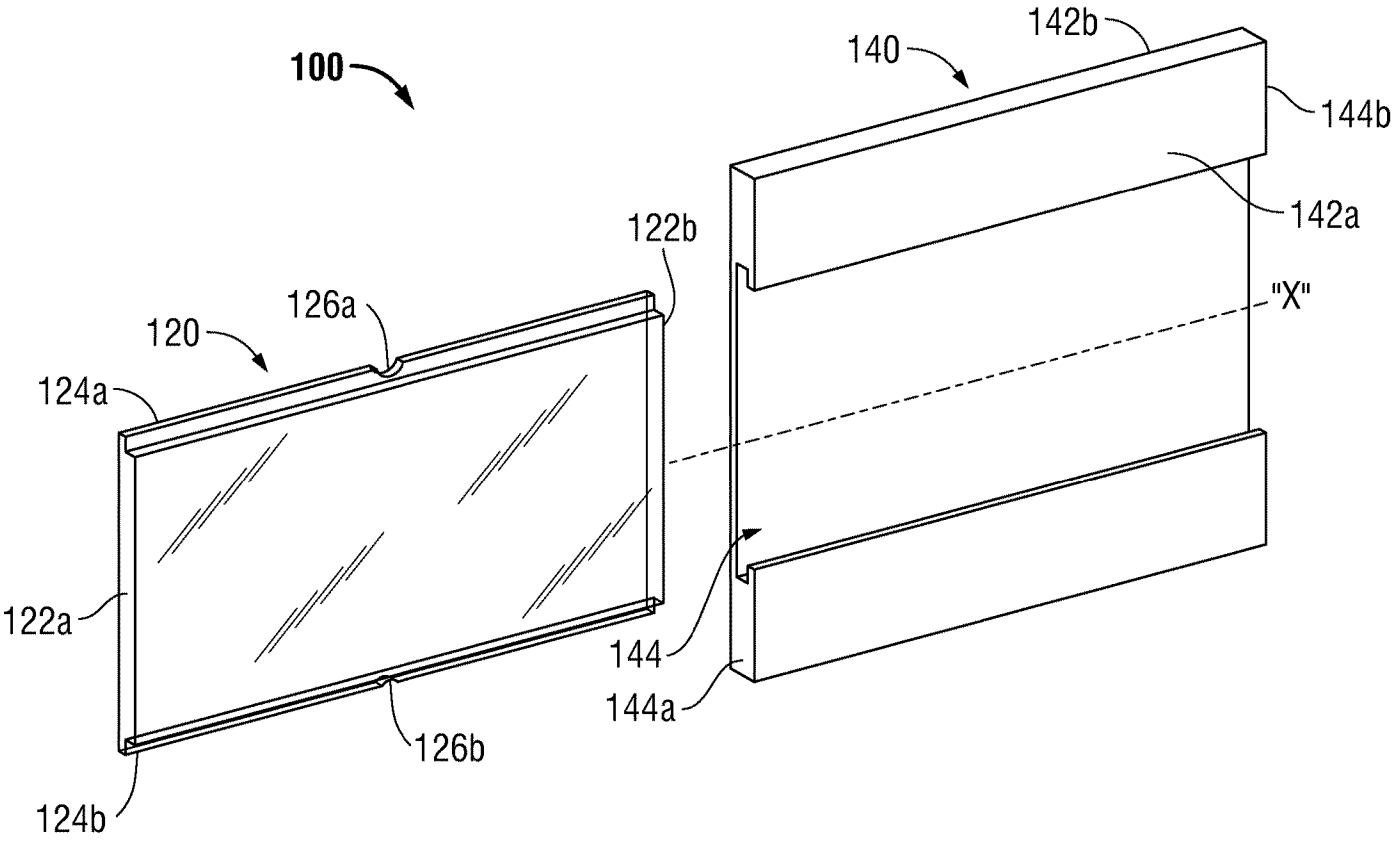
FIG. 7 is a perspective view of one embodiment of a nameplate in accordance with the principles of the present disclosure including a nameplate insert and a nameplate holder.

With reference to FIG. 7, nameplate insert 120 has a first lateral side 122*a*, a second lateral side 122*b*, an upper longitudinal side 124*a*, and a lower longitudinal side 124*b*. Upper longitudinal side 124*a* defines a notch 126*a* therein configured to capture a portion 176 of a locking member 172 of locking assembly 170. Lower longitudinal side 124*b* may also define a notch 126*b* therein that is also configured to capture the portion 176 of the locking member 172. Notches 126*a*, 126*b* have an arcuate configuration. In some embodiments, notch 126*a* may have a first dimension or shape, such as, for example, an arcuate configuration configured for engaging a correspondingly shaped portion 176 of locking member 170, whereas notch 126*b* may have a second dimension or shape, such as, for example, a rectangular configuration configured for engagement with correspondingly shaped projection 76 of locking member 72 of locking assembly 70 described above with regard to FIGS. 1-6C. As such, nameplate insert 120 may be used with either one of locking assemblies 70, 170 of the present disclosure.

With reference to FIG. 7, nameplate holder 140 includes a front surface 142*a* and a rear surface 142*b*. Front surface 142*a* defines a longitudinal channel 144 that extends from a first lateral side 144*a* of nameplate holder 140 to a second lateral side 144*b* of nameplate holder 140. Longitudinal channel 144 is configured to slidably receive a nameplate insert, such as, for example, nameplate insert 120.

Figure 8A:
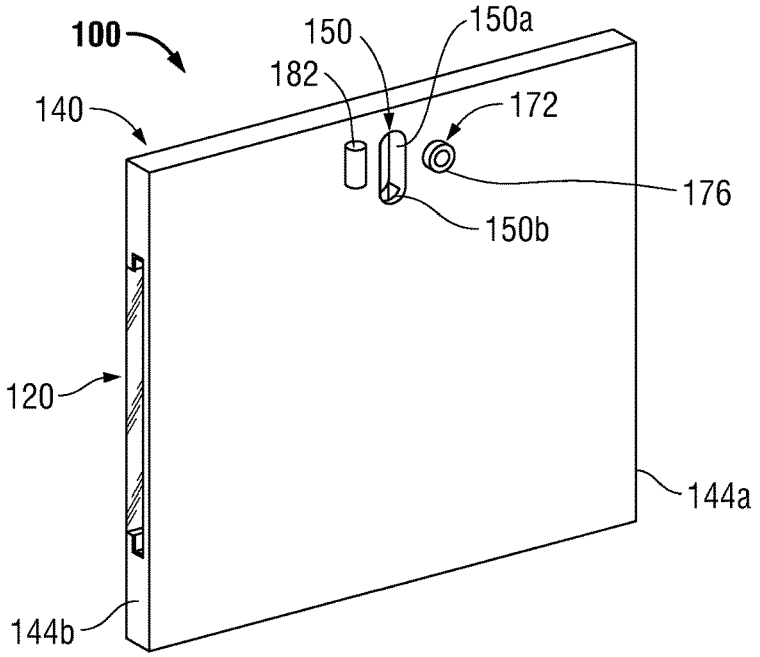
FIG. 8A is a rear, perspective view of the nameplate of FIG. 7 including a locking assembly of the nameplate.

With reference to FIG. 8A, rear surface 142*b* of nameplate holder 140 defines a cavity, such as, for example, a counterbore 150, similar to counterbore 50 described above. Counterbore 150 is configured for removable receipt of locking assembly 170, as will be described in greater detail below. Counterbore 150 includes a first hole 150*a* and a second hole 150*b*, smaller than first hole 150*a*, and is contiguous with first hole 150*a*. First hole 150*a* has a generally oblong shape and is disposed above longitudinal channel 144 of nameplate holder 140 and intermediate of first and second lateral sides 144*a*, 144*b* of nameplate holder 140. Second hole 150*b* has a diameter that is smaller than a diameter of locking member 172 to prevent locking member 170 from falling through second hole 150*b* into longitudinal channel 144. The diameter of second hole 150*b* is configured to allow for a passage of only a bottom portion 176 of locking member 172. Second hole 150*b* is contiguous with longitudinal channel 144 (See FIG. 9) such that longitudinal channel 144 can be accessed through counterbore 150.

Figure 8B:
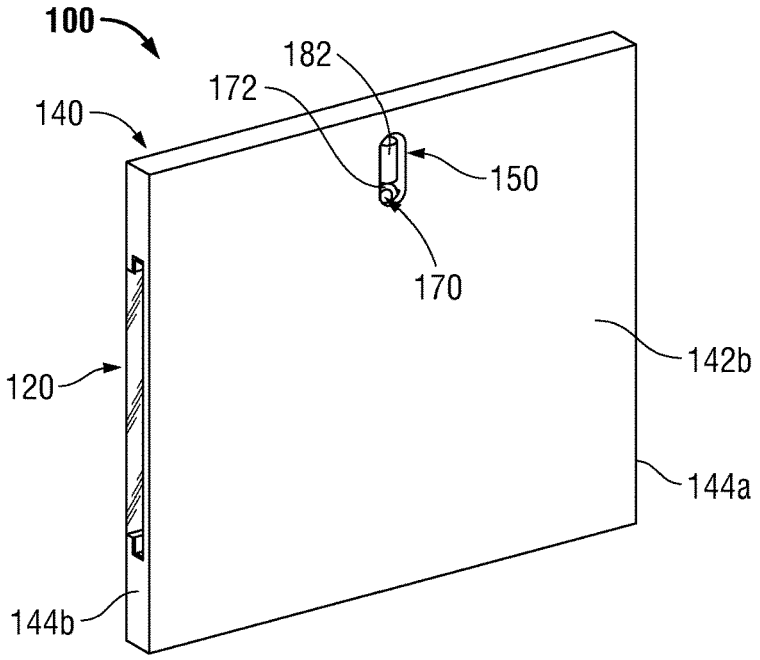
FIG. 8B is a rear, perspective view of the nameplate of FIG. 8A with the locking assembly in a locking condition.
Figure 9:
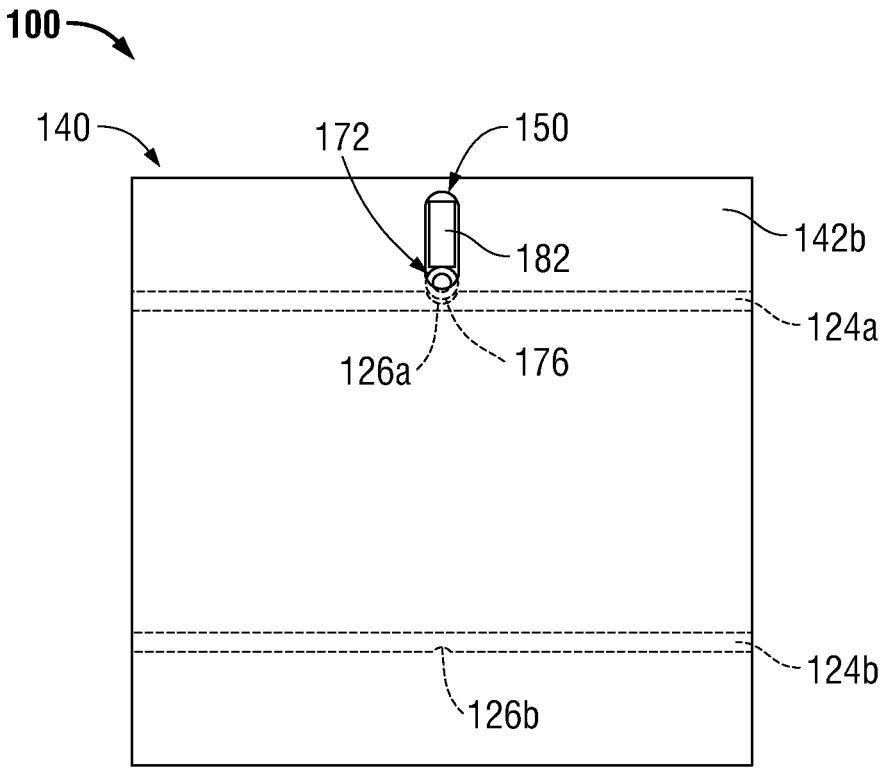
FIG. 9 is a rear, plan view, in part phantom, of the nameplate of FIG. 8B.

With reference to FIGS. 8A, 8B, and 9, nameplate 100 includes a locking assembly 170 for releasably locking nameplate insert 120 within longitudinal channel 144 of nameplate holder 140. Locking assembly 170 generally includes a locking member 172 and a resilient member 182. Locking member 172 is movable within nameplate holder 140 between a first or locking condition in which nameplate insert 120 is locked with nameplate holder 140, and a second or non-locking condition in which nameplate insert 120 is unlocked from nameplate holder 140.

Locking member 172 has an annular shape and is configured to sit within second hole 150*b* of counterbore 150 of nameplate holder 140. Locking member 172 is shaped and dimensioned such that a bottom portion 176 of locking member 172 extends through second hole 150*b* of counterbore 150 and into longitudinal channel 144. Locking member 172 may be fabricated from various materials, such as, for example, rigid materials (e.g., metals) or resilient materials (e.g., rubbers or plastics).

Locking assembly 170 further includes a resilient member 182. Resilient member 182 has a generally cylindrical shape and is dimensioned to be received within first hole 150*a* of counterbore 150 and supported on locking member 172. Resilient member 182 is fabricated from a resilient material, such as, for example, rubber. Resilient member 182 is captured within first hole 150*a* between locking member 172 at one end and a top surface of counterbore 150 at another end. In some embodiments, locking member 172 and resilient member 182 may be monolithically formed or integrally connected to one another. In some embodiments, resilient member 182 may variously shaped, such as, for example, rectangular, triangular, circular, oblong, tapered, uniform, non-uniform, or polygonal.

In assembly, operation, and use, locking member 172 is positioned within counterbore 150 and resilient member 182 is disposed in abutment with locking member 172 to resiliently bias lower portion 176 of locking member 172 into longitudinal channel 144 of nameplate holder 140. Nameplate insert 120 is slid into longitudinal channel 144 of nameplate holder 140 to engage lower portion 176 of locking member 172 to urge locking member 172 up, away from longitudinal channel 144. As locking member 172 moves up, resilient member 182 is compressed from a non-compressed condition to a compressed condition allowing locking member 172 to move up and out of longitudinal channel 144 and into the second or non-locking condition.

Nameplate 120 is slid within longitudinal channel 144 until notch 126*a* of nameplate insert 126*a* is aligned with counterbore 150 of nameplate holder 140. Upon aligning notch 126*a* of nameplate insert 120 with counterbore 150, locking member 172 is urged into notch 126*a* of nameplate insert 120 via the resilient bias of resilient member 182 and/or gravity to place locking member 172 in the first or locking condition. With lower portion 176 of locking member 172 being disposed within notch 126*a* of nameplate insert 120, movement of nameplate insert 120 along longitudinal axis "X" relative to nameplate holder 140 is resisted.

To selectively remove nameplate insert 120 from nameplate holder 140, a threshold amount of force imparted on nameplate insert 120, in a direction along longitudinal axis "X," urges locking member up and out of notch 126*a* of nameplate insert 120 to unlock nameplate insert 120 from nameplate holder 140.

In one embodiment, at least the lower portion 176 of locking member 172 is fabricated from a resilient material such that lower portion 176 of locking member 172 flexes between the first and second conditions upon the selective disengagement and engagement of nameplate insert 120 with locking member 172, respectively.

It will be understood that various modifications may be made to the embodiments disclosed herein. Therefore, the above description should not be construed as limiting, but merely as exemplifications of various embodiments. Those skilled in the art will envision other modifications within the scope and spirit of the claims appended thereto.

What is claimed is:

1. A nameplate, comprising:

a nameplate holder defining a longitudinal channel;

a backside;

a nameplate insert defining a notch and configured for movable receipt within the longitudinal channel of the nameplate holder; and a locking assembly configured for releasably locking the nameplate insert, the locking assembly including:

a locking member having at least a body, and a portion wherein the body is configured to include a metallic region, and a capture member configured to correspond flush with the backside of the nameplate holder and adjacent to the locking member;

wherein the locking assembly configured for full removable receipt from the nameplate holder with a magnetic member; and a counterbore in communication with the longitudinal channel, the counterbore includes a first hole and a second hole, smaller than the first hole and contiguous with the first hole;

wherein the diameter of the second hole is configured to allow for passage of a portion of the locking member; and the counterbore being configured for movable receipt of the locking member;

wherein the locking member is movable within the nameplate holder between:

a first condition in which a portion of the locking member extends within the notch of the nameplate insert to resist longitudinal movement of the nameplate insert relative to the nameplate holder; and a second condition in which the portion of the locking member is disposed outside of the notch of the nameplate insert.

2. The nameplate according to claim 1, further comprising a magnetic member configured to move the locking member between the first and second conditions via the metallic region of the locking member and to remove the locking member and the capture member from the nameplate holder.

3. The nameplate according to claim 1, wherein the counterbore is in communication with the longitudinal channel, the counterbore being configured for movable receipt of the locking member.

4. The nameplate according to claim 3, wherein the locking member includes a body and the portion of the locking member projects from the body such that in the first condition, the body of the locking member is disposed within the counterbore of the nameplate holder and the portion of the locking member protrudes into the longitudinal channel of the nameplate holder.

5. The nameplate according to claim 3, further comprising a resilient member configured for receipt in the counterbore of the nameplate holder and supported on the locking member, wherein in the first condition, the resilient member is in a non-compressed condition in which the portion of the locking member protrudes into the longitudinal channel of the nameplate holder, wherein in the second condition, the resilient member is in a compressed condition in which the portion of the locking member is disposed within the counterbore of the nameplate holder.

6. The nameplate according to claim 5, wherein the locking member has an annular shape.

7. The nameplate according to claim 1, wherein the portion of the locking member moves from the second condition to the first condition upon engagement of the nameplate insert with the locking member.

8. The nameplate according to claim 7, wherein the portion of the locking member is fabricated from a resilient material such that the portion of the locking member flexes from the second condition to the first condition upon engagement of the nameplate insert with the locking member.

9. The nameplate according to claim 1, wherein the nameplate insert includes:

a first longitudinal side; and a second longitudinal side;

wherein the longitudinal channel of the nameplate holder includes:

a first longitudinal groove for receiving the first longitudinal side of the nameplate insert; and a second longitudinal groove for receiving the second longitudinal side of the nameplate insert.

10. The nameplate according to claim 9, wherein the notch of the nameplate insert is defined in the first longitudinal side of the nameplate insert, the nameplate insert defining another notch in the second longitudinal side of the nameplate insert.

11. The nameplate according to claim 10, wherein the notch defined in the first longitudinal side of the nameplate insert has a first dimension and the another notch defined in the second longitudinal side of the nameplate insert has a second dimension, different than the first dimension.

12. A nameplate, comprising:

a nameplate holder defining:

a longitudinal channel configured for removable receipt of a nameplate insert;

a locking assembly configured for releasably locking the nameplate insert, the locking assembly including:

a locking member having at least a body, and a portion wherein the body is configured to include a metallic region, and a capture member configured to correspond with a counterbore and adjacent to the locking member;

wherein the locking assembly configured for full removable receipt from the nameplate holder with a magnetic member; and a counterbore in communication with the longitudinal channel, the counterbore includes a first hole and a second hole, smaller than the first hole and contiguous with the first hole;

the diameter of the second hole is configured to allow for passage of a portion of a locking member; and the counterbore being configured for movable receipt of the locking member.

13. The nameplate according to claim 12, wherein the locking member includes:

a body; and a projection stemming from the body such that in a first condition of the locking member, the body of the locking member is disposed within the counterbore of the nameplate holder and the projection of the locking member protrudes into the longitudinal channel of the nameplate holder.

14. The nameplate according to claim 12, wherein at least a region of the locking member is metallic.

15. The nameplate according to claim 12, wherein at least a portion of the locking member is fabricated from a resilient material such that the at least the portion of the locking member flexes from a non-compressed condition, in which the at least the portion of the locking member protrudes into the longitudinal channel of the nameplate holder, to a compressed condition, in which the at least the portion of the locking member is disposed within the counterbore of the nameplate holder.

16. The nameplate according to claim 12, further comprising a resilient member configured for receipt in the counterbore of the nameplate holder and supported on the locking member, wherein in a compressed condition of the resilient member, at least a portion of the locking member is disposed within the counterbore of the nameplate holder, and in a non-compressed condition of the resilient member, the at least the portion of the locking member protrudes into the longitudinal channel of the nameplate holder.

* * * * *